United States Patent [19]

Stech

[11] 4,104,148

[45] Aug. 1, 1978

[54] ELECTROPLATING TANK HAVING ELECTRIC RINSE WATER HEATING SYSTEM

[75] Inventor: Don W. Stech, Broadview Hts., Ohio

[73] Assignee: The Raymond Lee Organization, Inc., New York, N.Y. ; a part interest

[21] Appl. No.: 688,710

[22] Filed: May 21, 1976

[51] Int. Cl.[2] ..... C25B 9/00; H05B 3/00; F24H 1/16

[52] U.S. Cl. ..... 204/242; 13/23; 204/274; 219/201; 219/300

[58] Field of Search ..... 219/300, 295, 284, 200, 219/201; 204/262, 274, 275, 242, 280, 286, 241; 13/23

[56] References Cited

U.S. PATENT DOCUMENTS

| | | | |
|---|---|---|---|
| 742,131 | 10/1903 | Pratt | 204/242 |
| 1,175,470 | 3/1916 | Perkins | 219/300 |
| 1,561,276 | 11/1925 | Pankratz | 219/300 |
| 2,033,111 | 3/1936 | Carleton | 219/300 X |
| 2,478,917 | 8/1949 | Hain | 219/300 X |

FOREIGN PATENT DOCUMENTS

| | | | |
|---|---|---|---|
| 323,801 | 8/1920 | Fed. Rep. of Germany | 219/295 |
| 866,096 | 4/1961 | United Kingdom | 219/300 |

*Primary Examiner*—A. Bartis
*Attorney, Agent, or Firm*—Daniel Jay Tick

[57] ABSTRACT

A system for heating water to be utilized for rinsing material plated in an electroplating tank includes an electrically conductive water coil electrically connected in series between the spaced segments of a bus bar carrying current of 2000 Amps. at 12–15 volts D.C. to the plating tank. The inlet and outlet of the water coil are connected to a water tank and circulation of water from the water tank through the coil is effected either by a pump or by thermosyphonic action.

2 Claims, 2 Drawing Figures

10
WATER TANK
PUMP
12
WATER
5
6
11
ELECTRICAL INSULATOR
9
14
4
1
PLATING TANK
7
13
8
ELECTRICAL INSULATOR
3
+2000 A.
SOURCE OF ELECTRICAL ENERGY
2000 AMPS.
12-15 VOLTS D.C.
2

PLATING TANK
4
5
6
ELECTRICAL INSULATOR
13
10
14
11
8
9
WATER TANK
7
3
ELECTRICAL INSULATOR
ELECTRICAL ENERGY SOURCE
2

ELECTROPLATING TANK HAVING ELECTRIC RINSE WATER HEATING SYSTEM

SUMMARY OF THE INVENTION

The present invention relates to a water heating system. More particularly, the invention relates to a water heating system in a plating tank system having a plating tank, a source of electrical energy and electrical conductors conducting electrical energy from the source of electrical energy to the plating tank.

Objects of the invention are to provide a water heating system of simple structure, which is inexpensive in manufacture, installed with facility and convenience in new and existing plating tank systems, and functions efficiently, effectively and reliably to utilize electrical energy to heat water.

In accordance with the invention, a plating tank system for plating items, said plating tank system having a plating tank, a source of electrical energy and electrical conductors conducting electrical energy from the source of electrical energy to the plating tank, is combined with a water tank system comprising a water tank having water therein to be heated for washing items plated in the plating tank system. A water coil of electrically conductive material is electrically connected between the electrical conductors of the plating tank system in a manner whereby electrical energy from the source of electrical energy heats the coil. The water coil has spaced opposite ends. A duct connects one end of the water coil to the water tank. An additional duct connects the other end of the water coil to the water tank. A pump in a duct circulates water from the water tank through the duct, water coil and additional duct whereby the water is heated by electrical energy from the source of electrical energy. Alternatively, water circulation can be effected by thermosyphonic action, thereby making the pump unnecessary.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figures 1, 2:
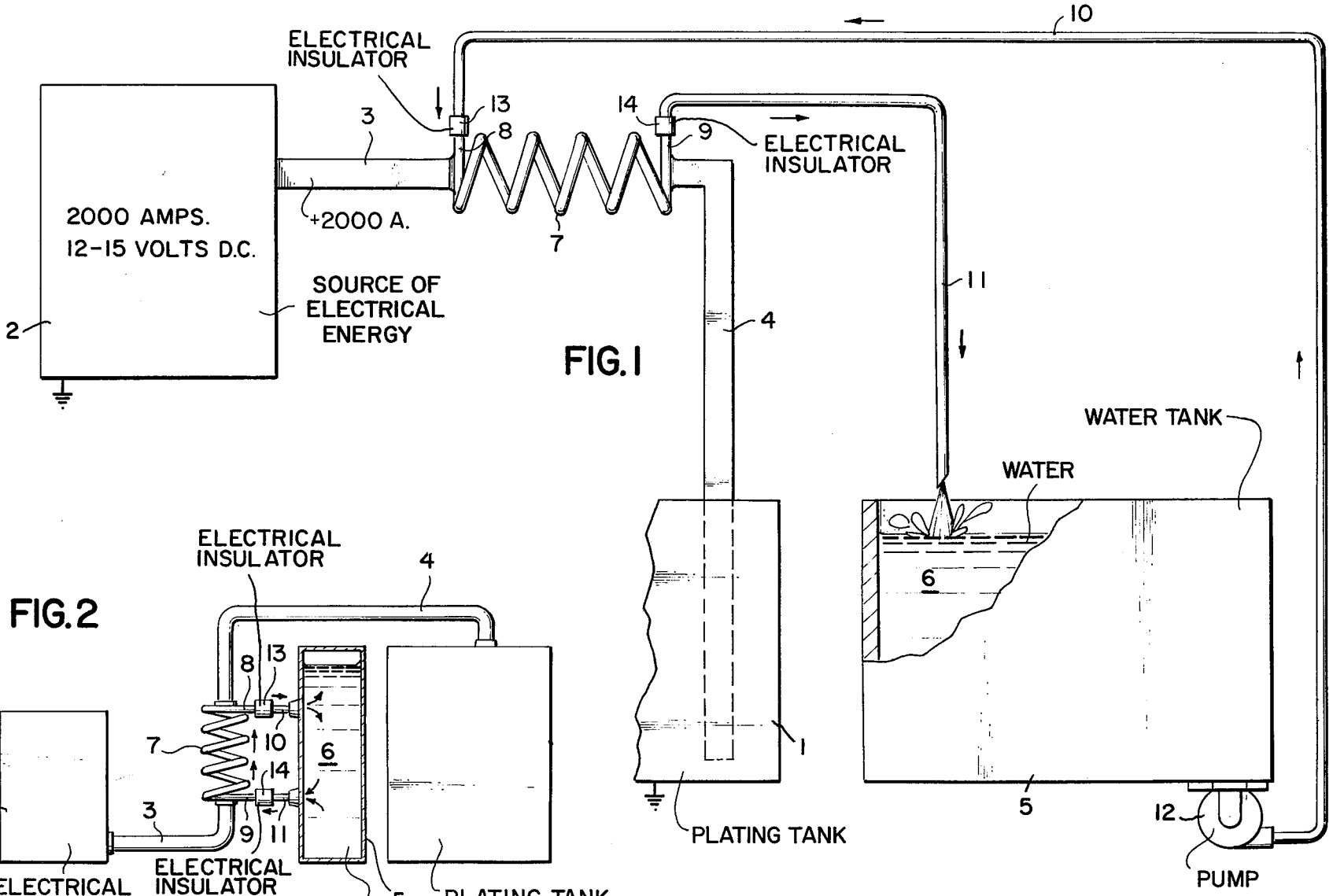
FIG. 1 is a schematic diagram, partly cutaway and partly in section, of the embodiment of the water heating system of the invention.
FIG. 2 is a schematic diagram of a modification of the embodiment of FIG. 1.

The water heating system of the invention is provided in a plating tank system having a plating tank 1 of any suitable known type, a source of electrical energy 2 of any suitable known type, adequate for providing a plating operation in the plating tank, and electrical conductors or bus bars 3 and 4 conducting electrical energy of approximately 2000 amperes from the source of electrical energy to the plating tank.

The water heating system of the invention comprises a water tank 5 having water 6 therein to be heated. The heated water of the water tank 5 is preferably utilized to rinse material plated in the plating tank 1.

A water coil 7 of electrically conductive material of any suitable type is electrically connected between the conductors 3 and 4 of the plating tank system in a manner whereby electrical energy from the source of electrical energy heats the coil. The source of electrical energy 2 is preferably a 12 to 15 volt DC source producing 2000 amps DC for the plating process. The water coil 7 has spaced opposite ends 8 and 9.

A duct 10 connects one end 8 of the water coil 7 to the water tank 5. An additional duct 11 connects the other end 9 of the water coil 7 to the water tank 5.

In the embodiment of FIG. 1, a pump 12 of any suitable type is provided in the duct 10 for circulating water from the water tank 5 through the duct 10, the water coil 7 and the additional duct 11 whereby the water is heated by electrical energy from the source of electrical energy.

Electrical insulators 13 and 14 are interposed between the duct 10 and the end 8 of the water coil and between the duct 11 and the end 9 of the water coil, respectively, to prevent the loss of electrical energy via said ducts.

The modification of FIG. 2 has the same components as the embodiment of FIG. 1 with the exception of the pump 12. In the modification of FIG. 2 the water from the water tank 5 circulates through the water coil 7 by thermosyphonic action as indicated by the arrows in FIG. 2, so that the pump 12 is eliminated.

While the invention has been described by means of a specific example and in a specific embodiment, I do not wish to be limited thereto, for obvious modifications will occur to those skilled in the art without departing from the spirit and scope of the invention.

I claim:

1. The combination of a plating tank system for plating items, said plating tank system having a plating tank, a 12–15 volt, 2000 amp. DC source of electrical energy and an electrical bus bar having two spaced apart segments conducting electrical energy from the source of electrical energy to the plating tank; and a water tank system comprising a water tank having water therein to be heated for washing items plated in the plating tank system, a water coil of electrically conductive material electrically bridging the gap between the segments of the electrical bus bar of the plating tank system and electrically connecting said bus bar segments in series current flow relationship in a manner whereby current can flow from the source of electrical energy, through one bus bar segment, the water coil and the other bus bar segment to the plating tank to heat the coil, said water coil being capable of carrying a current of 2000 amps at 12–15 volts DC and having spaced opposite ends, duct means connecting one end of the water coil to the water tank, additional duct means connecting the other end of the water coil to the water tank, pump means in the duct means for circulating water from the water tank through the duct means, water coil and additional duct means whereby said water is heated by electrical energy from the source of electrical energy, and a current return path from the plating tank back to said source of electrical energy.

2. The combination claimed in claim 1, further comprising electrically insulative means interposed between the duct means and the ends of the water coil to prevent the loss of electrical energy via said duct means.

* * * * *